United States Patent [19]

Knittel

[11] Patent Number: 4,757,925

[45] Date of Patent: Jul. 19, 1988

[54] BABY CARRIER

[76] Inventor: Suzanne Knittel, 7245 Sycamore Trail, Los Angeles, Calif. 90068

[21] Appl. No.: 815,378

[22] Filed: Dec. 31, 1985

[51] Int. Cl.[4] ..... A61G 5/00

[52] U.S. Cl. ..... 224/158

[58] Field of Search ..... 294/140; 224/158–161

[56] References Cited

U.S. PATENT DOCUMENTS

| | | | |
|---|---|---|---|
| 576,292 | 2/1897 | Vanderburgh | 224/159 |
| 3,254,815 | 6/1966 | Bugge | 224/159 |
| 3,841,543 | 10/1974 | Bolton | 224/158 |
| 4,166,558 | 9/1979 | Schroeder | 224/158 |
| 4,436,233 | 3/1984 | Hill et al. | 224/159 |
| 4,469,259 | 9/1984 | Krich et al. | 224/159 X |
| 4,492,326 | 1/1985 | Storm | 224/159 X |

FOREIGN PATENT DOCUMENTS

| | | | |
|---|---|---|---|
| 930883 | 2/1948 | France | 224/159 |
| 2336903 | 7/1977 | France | 224/158 |
| 2371906 | 7/1978 | France | 224/158 |
| 16884 | of 1890 | United Kingdom | 224/158 |

*Primary Examiner*—Henry J. Recla
*Assistant Examiner*—Robert M. Petrik
*Attorney, Agent, or Firm*—Thomas I. Rozsa

[57] ABSTRACT

A baby carrier having a pouch with an adjustable shoulder strap connected at each end of the pouch and a plurality of gathers at each end of the pouch to be worn across the user's front.

2 Claims, 2 Drawing Sheets

BABY CARRIER

BACKGROUND OF THE INVENTION

1. Field of the Invention

The present invention relates to the field of baby carriers. More specifically, the present invention relates to soft, sling-type baby carriers designed to be worn across the user's front upper body.

2. The Prior Art

Caring for babies has always limited the mobility of the mother or other care-giver because the baby must be carried from place to place. Throughout history, efforts have been made to increase the mobility of mothers and reduce their fatigue by fashioning some kind of baby carrier. These efforts have produced devices ranging from the flat boards with leather ties of some American Indians to elaborate baby carriages complete with suspension springs and brakes. The flat boards used to carry papooses were uncomfortable and led to minimal contact with mother. Baby carriages are bulky, heavy, expensive, and eliminate most contact with the baby.

Much of the prior art attempts to provide a baby carrier that overcomes these difficulties. Some prior art has been directed toward simple, soft fabric baby carriers designed to be worn on user's chest or back, thereby providing adequate contact between the child and the user while easing the user's fatigue and leaving the user's hands free.

One of the first such devices to be developed is an improvised sling formed by tying the ends of a length of cloth together. This type of sling is still commonly used in Africa. In use, the sling is retied everyday by bending forward sharply at the waist and typing a knot behind the back. The gathers that result from typing the ends of a relatively wide piece of cloth into a knot are bulky and uncomfortable. In addition, retying the sling everyday is a time consuming nuisance.

Another prior art device consists of a sling which is wider in the middle than at its ends and is adjusted by means of two wooden rings that the ends are passed through. This sling is designed to be worn diagonally across the user's chest with the narrower portion across one of the user's shoulders and back. Such devices do not conform well to the baby's size and shape, having the tendency to gather under the baby's body. This difficulty can leave the baby in danger of falling from the sling, requiring the user to keep generally at least one hand on the baby.

Another sling-like device for carrying a baby has a triangular-shaped seat. The narrow end of the seat is positioned in the child's crotch and the wide portion on his hips. A strap attached to both corners of the wide portion of the seat is worn over one of the user's shoulders. A second strap is attached to the crotch portion of the seat and strapped around the user's waist. Such a baby carrier is difficult to put on, requiring a strap or chair. It distributes weight primarily on the user's shoulders, increasing fatigue. It can only be safely used with babies who can sit up, so it cannot be used with young infants or sleeping babies. The seat of the sling is not comfortable for baby because all the baby's weight is distributed across a small, tightly stretched piece of cloth, and the baby's legs are forced wide apart, a potentially unhealthy position. Finally, the back of the seat does not rise very high, even on a very yong baby, so a baby could fall out of it and the user must keep a hand on the baby at all times.

Another prior art device substantially reduces the risk that a baby might fall out of it, but the solution it reaches creates other difficulties. This device, which is sold under the name Snugli and is one of the most popular baby carriers, is essentially a back-pack designed to be worn on the chest or back. A strap is sewn onto each end of the top of the baby carrier. The opposite end of each strap is sewn onto the respective side of the baby carrier at a location intermediate the top and bottom of the baby carrier. In use, these two straps rest on the user's shoulders, circle under the arms, and lie along the user's rib cage. A third strap, along the bottom of the baby carrier, is designed to be worn around the user's waist. The length of all three straps is adjustable. The front of the baby carrier opens and closes length-wise down the middle. The inside of the baby carrier includes a pouch, which cradles the baby in a semi-sitting position. Zippers control these openings. The pouch hs a hole for each leg, so that the baby settles to the bottom of the pouch. The pouch can be moved downwardly by using a lower row of fasteners, such as snap fasteners, to accommodate a larger baby. The baby is secured in the baby carrier by placing his legs through the holes in the pouch, zipping up the pouch and then zipping up the outer cover. Next, the user puts on the shoulder straps and then fastens the waist strap. Finally, baby and user are ready to go. The baby is now facing the user's chest.

The baby carrier frees the user's hands, provides contact between user and baby, and transfers the baby's weight from the user's arm to her back. This device, however, has many difficulties, which include:

1. The baby carrier is difficult and expensive to manufacture, having numerous parts, seams, stitches and fasteners;

2. The shoulder straps are prone to slip or fall off the shoulders, a potentially dangerous shortcoming;

3. Riding in the baby carrier seems not to be comfortable for the baby, which is understandable since nearly all of his weight is distributed across the two straps, each about three inches wide, that are stretched tightly across his bottom and his legs must be widely spread apart sideways to fit into the pouch. These difficulties become more troublesome as the baby grows;

4. The baby cannot see much of any interest because his face is pressed against the user's chest;

5. Putting a baby in this baby carrier and putting it on is awkward and time consuming;

6. Wearing this baby carrier is awkward and places considerable and quite noticeable strain on the user's lower back.

Therefore, a significant need exists for a baby carrier that is safe, simple, easy to manufacture and to use, and that adjusts to different sized babies in different positions, and allows the baby substantial freedom of movement.

SUMMARY OF THE PRESENT INVENTION

Accordingly, it is an object of the present invention to provide a baby carrier that is safe to use, minimizing the risk that a baby can fall out of it.

Another object of the present invention is to provide a baby carrier that conforms to the baby's body regardless of his size or position.

Another object of the present invention is to provide a baby carrier that allows the baby substantial freedom of movement.

Another object of the present invention is to provide a baby carrier that easily permits discreet nursing.

Another object of the present invention is to provide a baby carrier that is comfortable for both the user and the baby.

Another object of the present invention is to provide a baby carrier that leaves the user's hands free.

Another object of the present invention is to provide a baby carrier that is easy to use.

These and other objects of the present invention are achieved by providing a baby carrier as illustrated in the figures, and as described and claimed in this patent.

DETAILED DESCRIPTION OF THE PREFERRED EMBODIMENT

Figure 4:
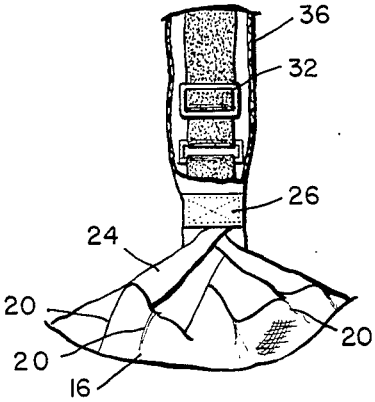
FIG. 4 is a detail view of one end of the baby carrier illustrating attachment of the yoke to the pouch and strap.
Figure 5:
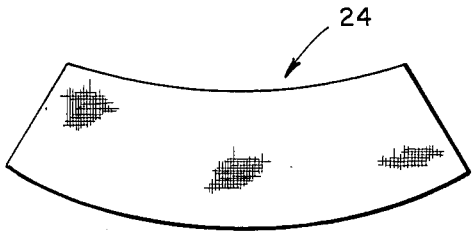
FIG. 5 is a plan view of the pattern for the yoke.

A baby carrier 10 according to the present invention includes pouch 12 having strap 14 attached at each end 16, 18 of pouch 12. Each end 16, 18 of pouch 12 includes gathers at 20, 22 which form rolling pleat-like folds throughout the length of pouch 12. Each end of pouch 12 is attached to a yoke 24 by forming a plurality of gathers 20, 22 in pouch 12, under the longer side of yoke 24, while yoke 24 (see FIG. 5) is flat. Approximately two inches along each longitudinal edge of pouch 12 is not gathered, but is sewn flat against the correspondly flat edge of yoke 24 effectively providing an ungathered border along both longitudinal edges of pouch 12. Then yoke 24 and pouch 12 are sewn together. The shorter side of yoke 24 is folded about itself to form a short strip that protrudes from the end of pouch 12 along its longitudinal axis. The resulting strip is about the same width as strap 14. Band 26 is then placed around strap 14 and the folded end of yoke 24, and the three pieces are sewn together. The solid lines in the yoke in FIG. 4 indicate fold lines formed by folding yoke 24 to conform to strap 14. (These folds are not sewn together, but merely hang in the illustrated fashion due to the sewing of yoke 24 to strap 14.) Lines radiating from yoke 24 onto pouch 12 indicate gathers.

The yoke construction described above results in an extensively gathered pouch that is not bulky and lies substantially flat, a great improvement over the prior art. The present invention can make large and numerous gathers substantially flat, pliable and of small volume by essentially gathering the material twice—first, by gathering it along the widen portion of a relatively broad yoke and then gathering the narrower portion of yoke 24 itself by folding prior to sewing yoke 24 to strap 14.

A further refinement of the invention includes a finished pouch 12 wherein the lengthwise folds throughout pouch 12 run from one side of the pouch to the other. This results in a baby carrier 10 that readily conforms to the size and position of the baby and whose effective volume readily expands and contracts in response to the baby's movement. The running or rolling folds throughout the length of pouch 12 result from the type of connection of pouch ends to strap 14. After pouch 12 is gathered and sewn to yoke 24, yoke 24 is folded a number of times until it is substantially the same width as strap 14. The manner of folding yoke 24 determines how the finished assembly of yoke 24, and pouch end 16 or 18 will lie. Yoke 24, attached to strap 14, is layed flat and a fold is made substantially along a radial line of yoke 24 to one side (left) of the vertical center line of yoke 24. The folded portion of yoke 24 is then folded back against itself, also substantially along a radial line of yoke 24 and substantially parallel to the first fold. Then the process is repeated on the other side (right0 of the vertical center line of yoke 24. Double folds are made in this manner on one side, then the other, alternating from one to the other side, of the vertical center line of yoke 24 until all the narrow side of yoke 24 is folded into a band substantially the width of strap 14. Yoke 24 can now be described as having a bottom, which is flat, and a top, that is, the surface that was up when the folds were made, which includes the fan-like fold lines shown in FIG. 4.

The folding process described in the paragraph above is performed on both ends of pouch 12 with one exterior surface of pouch 12 facing upwardly; that is, the top of both yokes 24 is facing upwardly when the folding step is complete. In the preferred embodiment illustrated in the drawing figures, the body of pouch 12 is twisted one-half a turn so that the folds of yoke 24 are upwardly facing at the shoulder connection and downwardly facing at the hip connection. This construction causes the folds in pouch 12 to run from the side of pouch 12 away from the user to the side of pouch 12 that is adjacent to the user, thereby providing a more secure baby carrier that more readily expands and contracts to conform to the movements of the baby. In use, the baby's weight is usually distributed over a large part of the baby's body, reducing irritation at any one point and increasing the baby's comfort. Additionally, the mother can nurse the baby discreetly by pulling slack material in pouch 12 up over her chest.

In a preferred embodiment, pouch 12 requires $1\frac{1}{4}$ to $1\frac{1}{2}$ or more yards of cloth taken from a standard bolt. It is readily apparent that gathering $1\frac{1}{2}$ yards of cloth or more into a band narrow enough to fit comfortably over one's shoulder would not be easy, absent the present invention. The pattern of pouch 12 (FIG. 6) was developed empirically from much trial and error over a period of years and contributes significantly to the utility and comfort of the present invention. After construction and in use, the orientation of pouch 12 in baby carrier 10 is this: side 40 is adjacent the user's body, with hip point 42; attached to one end of strap 14, riding on user's right hip; shoulder point 44, attached to the other end of strap 14, on the user's left shoulder; and side 46 on the side away from the user's body and substantially parallel to side 40. Strap 14 then crosses the user's back diagonally downward from the left shoulder.

Side 40 is shorter than side 46, providing a more snug fit next to user's body, improving contact with the baby. This feature also makes it easier to put the baby into the carrier by reducing the possibility that a leg or other body part might slip between baby carrier 10 and the user. It also keeps the baby closer to the user, which reduces or eliminates the lower back strain frequently encountered in baby carriers.

The curves that pass through hip point 42 and shoulder point 44 were also developed empirically. While it is apparent that many designs and variations from the pattern of FIG. 6 could lead to an acceptable product, it has been found that a superior baby carrier results when the pattern of pouch 10 has the following general characteristics, which are apparent from FIG. 6. First, side 40 is shorter than side 46. Second, the curve passing through hip point 42 has a larger bulge and extends farther from the general body of pouch 12 than is the case of the curve passing through shoulder point 44. This provides a greater area (and greater volume when assembled) of fabric where the baby is and a smaller area (and correspondingly smaller volume when assembled) where the pouch meets the shoulder strap. The curves through hip point 42 and shoulder point 44 are not segments of circles, but are French curves.

Figure 2:
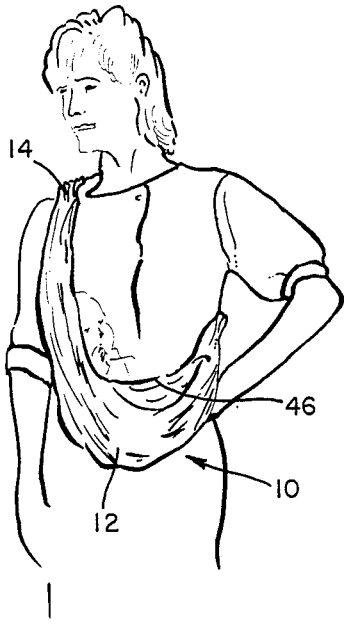
FIG. 2 is a perspective view of a left-handed model baby carrier according to the present invention in use.
Figure 7:
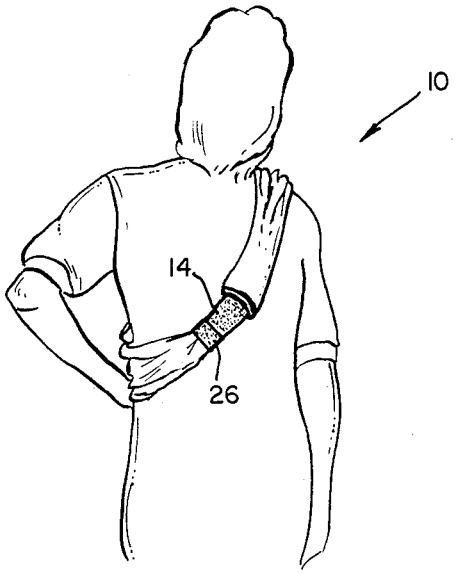
FIG. 7 is a perspective view of the left-handed model of a baby carrier in use taken from the back view of a user.
Figure 6:
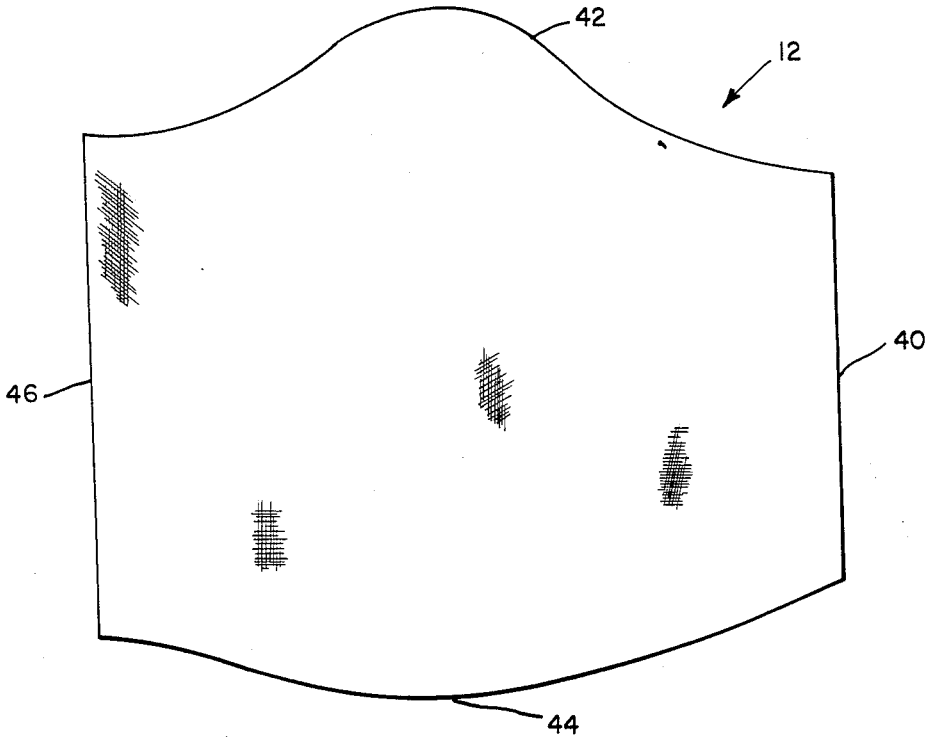
FIG. 6 is a plan view of the pattern for the pouch.

The asymmetrical design of pouch 12 mandates right-handed and left-handed models. A right-handed model is intended to be worn with shoulder point 44 over the user's left shoulder and hip point 42 riding at about the user's right hip. FIG. 6 illustrates the pouch pattern for a right-handed model. To make a left-handed model, rotate the pattern for pouch 12 (FIG. 6) 180 degrees of arc out of the plane of the paper from the top of FIG. 6 to the bottom. A left-handed model is illustrated in FIGS. 2 and 7. The other FIGS. can refer to left-handed or right-handed models.

An acceptable, although less desirable, pattern for pouch 12 that could be used for both right-handed and left-handed models has sides 40, 46 of equal length. Such embodiment would not fit as snugly against the user, but would simplify manufacturing and reduce costs. This alternative also requires a pouch made of material that is the same on both sides, requiring any lining to be added later. IF a material having an integral fuzzy lining, such as terry cloth, is used, then right-handed and left-handed models would have to be made from separate patterns to produce a soft pouch with an interior lining.

Strap 14 includes conventional sliding buckle 32 permitting easy adjustment of the length of strap 14.

Strap 14 includes shoulder pad 36 (FIG. 4), which may be a separate tube-like sleeve section of soft material for padding the user's shoulder, thus distributing weight over a greater area. Shoulder pad 36 may include a separate pad sewn to the inside of shoulder pad 36.

In use, strap 14 rests behind the user's shoulder, back and rib cage, distributing the baby's weight widely throughout the user's body and freeing user's hands and transferring much of the baby's weight to a hip, or other desired location along the front of her body at approximately waist level.

Figure 1:
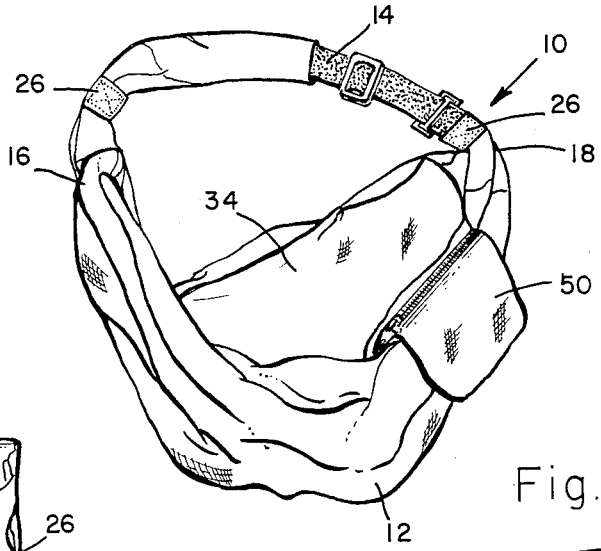
FIG. 1 is a perspective view of the baby carrier in an open position.
Figure 3:
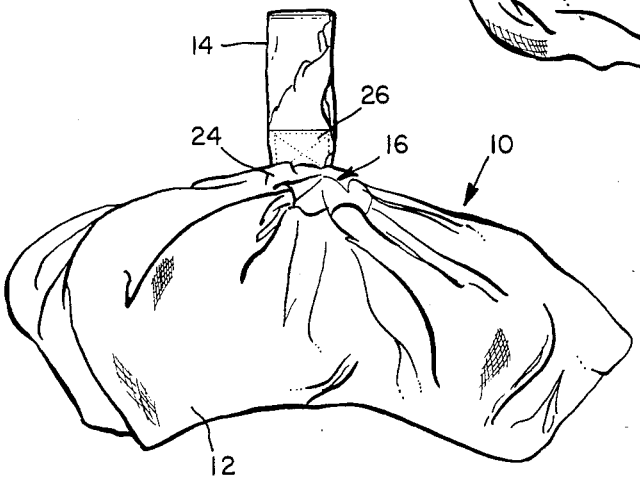
FIG. 3 is a plan view of one end of the baby carrier.

The inside 34 of pouch 12 is lined with a fuzzy material to provide warmth and a comforting texture to the baby. Pocket 50*a* (FIG. 1) may be included inside pouch 12 for holding items such as pacifiers, bottles, keys, and so forth.

While the preferred embodiments of the invention have been described in detail, it is apparent that various changes and modifications within the scope of this invention may occur to those skilled in the art. Accordingly, the detailed description is not intended to limit the features of the invention or the scope of the patent property to be granted, which should be measured solely by the claims that follow.

What is claimed is:

1. A baby carrier comprising:

a. an elongated pouch having gathers at each end;

b. a strap attached to both ends of said pouch forming a loop;

c. means for adjusting the length of said strap;

d. two yokes, one said yoke attached at each end of said pouch;

e. said gathers being formed under said yoke;

f. said yoke being fastened to said pouch end;

g. said yoke being fixedly attached to said strap;

h. the end of said yoke not secured to said pouch is folded to a dimension substantially the same as the width of said strap before being attached to said strap;

i. said yoke is attached to said strap by means of a sleeve that is placed around said strap and said yoke; and j. said strap, said yoke and said sleeve are fastened together.

2. A baby carrier comprising:

a. an elongated pouch having gathers at each end;

b. a strap attached to both ends of said pouch forming a loop;

c. means for adjusting the length of said strap;

d. two yokes, one said yoke attached at each end of said pouch;

e. said gathers being formed under said yoke;

f. said yoke being fastened to said pouch end;

g. said yoke being fixedly attached to said strap;

h. the end of said yoke not secured to said pouch is folded to a dimension substantially the same as the width of said strap before being attached to said strap;

i. said yoke is attached to said strap by means of a sleeve that is placed around said strap and said yoke;

j. said strap, said yoke and said sleeve are fastened together; and k. said pouch further comprises a pouch having a greater amount of material in the vicinity of the hip connection point than in the vicinity of the shoulder connection point.

* * * * *